US006990938B2

(12) United States Patent
Inomoto et al.

(10) Patent No.: US 6,990,938 B2
(45) Date of Patent: Jan. 31, 2006

(54) VALVE MECHANISM FOR INTERNAL COMBUSTION ENGINES

(75) Inventors: Yutaka Inomoto, Saitama (JP); Masahiro Kuroki, Saitama (JP); Takashi Tsutsumizaki, Saitama (JP); Kazuya Tanabe, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/495,195

(22) PCT Filed: Aug. 29, 2003

(86) PCT No.: PCT/JP03/11042

§ 371 (c)(1),
(2), (4) Date: May 11, 2004

(87) PCT Pub. No.: WO2004/031541

PCT Pub. Date: Apr. 15, 2004

(65) Prior Publication Data

US 2005/0161010 A1 Jul. 28, 2005

(30) Foreign Application Priority Data

Sep. 30, 2002 (JP) ..... 2002-286666

(51) Int. Cl.
*F01L 1/34* (2006.01)

(52) U.S. Cl. ..... 123/90.16; 123/90.15; 123/90.17; 123/90.31

(58) Field of Classification Search ..... 123/90.16, 123/90.17, 90.15, 90.31, 90.39
See application file for complete search history.

(56) References Cited

U.S. PATENT DOCUMENTS

| | | | | |
|---|---|---|---|---|
| 5,937,809 | A | 8/1999 | Pierik et al. | |
| 6,019,076 | A | 2/2000 | Pierik et al. | |
| 6,311,659 | B1 | 11/2001 | Pierik | |
| 6,401,677 | B1 * | 6/2002 | Rohe et al. | 123/90.16 |
| 2001/0037781 | A1 | 11/2001 | Fischer et al. | |
| 2002/0007810 | A1 | 1/2002 | Pierik | |

FOREIGN PATENT DOCUMENTS

| | | |
|---|---|---|
| JP | 01-167425 | 7/1999 |

* cited by examiner

*Primary Examiner*—Thomas Denion
*Assistant Examiner*—Zelalem Eshete
(74) *Attorney, Agent, or Firm*—Carrier Blackman & Associates, P.C.; Joseph P. Carrier; William D. Blackman

(57) ABSTRACT

A valve operating device for an internal combustion engine is capable of increasing a negative valve overlapping duration when maximum lift amounts of an intake valve and an exhaust valve are small. The valve operating device is provided with intake-side and exhaust-side characteristic adjustment mechanisms for adjusting operating characteristics of an intake valve and an exhaust valve. Each characteristic adjustment mechanism has a control cam rotating integrally with a cam shaft, an electric motor that causes a holder pivoted on the cam shaft to rotate about the cam shaft, a sub-rocker lever pivoted on the holder and caused to oscillate by the control cam, and a valve cam that is caused to oscillate around the cam shaft by oscillation of the holder and the sub-rocker lever, for causing oscillation of main rocker levers. The electric motor causes the holder to oscillate in such a manner that the valve open timing of the intake valve is retarded as a maximum lift amount of the intake valve becomes smaller and the valve close timing of the exhaust valve is advanced as a maximum lift amount of the exhaust valve becomes smaller.

9 Claims, 7 Drawing Sheets

VALVE MECHANISM FOR INTERNAL COMBUSTION ENGINES

TECHNICAL FIELD

The present invention relates to valve operating device for opening and closing operation of an intake valve and an exhaust valve of an internal combustion engine, and in more detail, relates to a valve operating device provided with characteristic adjustment mechanisms for adjusting valve open timing of an intake valve and valve close timing of an exhaust valve at the same time as adjusting a maximum lift amount of the intake valve and the exhaust valve.

BACKGROUND ART

A valve operating device provided with adjustment mechanisms for adjusting a valve open timing of an intake valve and valve close timing of an exhaust valve at the same time as adjusting a maximum lift amount of the intake valve and the exhaust valve is known from the disclosure of JP 2000-3721 A. The valve operating device is provided with an eccentric cam fixed to a drive shaft rotating in response to rotation of a crankshaft, an annular link rotatably engaged with the outer periphery of the eccentric cam, a rocker lever which is rotatably engaged with the outer periphery of a control cam that is fixed in an eccentric manner to a control shaft arranged substantially parallel to the drive shaft and which is pivoted about the annular link at one end thereof, and a rocking cam rotatably engaged with the drive shaft and connected to the other end of the rocker lever via a link.

The rocking cam for opening and closing operations of the intake valve and the exhaust valve oscillates to vary a maximum lift amount and an operating angle of each of the intake valve and the exhaust valve when variation of a distance between the rocking center of the rocker lever and the rotational center of the drive shaft occurs when the control shaft rotates in accordance with engine driving conditions. The control shaft is rotationally controlled in such a manner that as the maximum lift amounts of the intake valve and the exhaust valve become smaller, the maximum lift timing is moved towards being retarded at the intake valve, and moved towards being advanced at the exhaust valve. As a result, the valve open timing of the intake valve is retarded by an amount that is larger than the amount of advance of the valve close timing of the intake valve, while the valve close timing of the exhaust valve is advanced by an amount that is larger than the amount of retardation of the valve open timing of the exhaust valve, and it is thus possible to improve fuel consumption rate and purify the exhaust gas by using combustion gas retained in the combustion chamber.

On the other hand, SAE TECHNICAL PAPER SERIES, 2000-01-1221, (Mar. 6–9, 2000), "Design and Development of a Mechanical Variable Valve Actuation System" by Ronald J. Pierik and James F. Burkhard discloses a valve operating device for an internal combustion engine provided with an adjustment mechanism for advancing valve open timing of the intake valve as the maximum lift amount of the intake valve becomes smaller.

Here, the intake valve is opened and closed by a valve operating device provided with an adjustment mechanism, and the exhaust valve is opened and closed by the valve operating device that is not provided with a characteristic adjustment mechanism. The adjustment mechanism has an input cam provided on a cam shaft synchronized with a crankshaft, an output cam supported on a cam shaft, a frame pivoted on the cam shaft, a link with one end pivoted on the output cam so as to be capable of swinging, a rocker lever having a roller coming into contact with the input cam, and having one end pivoted on the frame and the other end pivoted on the link so as to be capable of swinging, and a control shaft for causing the frame to oscillate. As the maximum lift amount of the intake vales become smaller, the valve open timing is kept substantially the same, while the valve close timing is advanced.

With the valve operating device disclosed in JP 2000-3721 A, a movement angle at the maximum lift timing is determined by an angle through which the swinging center of the rocker lever rotates with respect to the center of rotation of the drive shaft, when the control cam is rotated by the control shaft. However, since the rocker lever is rotatably supported by a control cam fixed to the control shaft positioned away from the drive shaft supporting the rocking cam, the rotational angle of the oscillating center of the rocker lever around the rotational axis of the drive shaft is dependent on the amount of eccentricity of the rocker lever and is limited to a small value. This means that it is difficult to cause a large amount of combustion gas to be retained in the combustion chamber by carrying out a large amount of retard of the intake valve open timing and a large amount of advance of the exhaust valve close timing, thus increasing the duration from the closing of the exhaust valve to the opening of the intake valve during the period from the exhaust stroke and to the intake stroke (referred to hereinafter as "negative valve overlaping duration").

On the other hand, the valve operating device disclosed in "Design and Development of a Mechanical Variable Valve Actuation System" mentioned hereinabove is not provided with a mechanism for adjusting the valve close timing in the exhaust valve operating device, and it is difficult to retain a sufficient combustion gas in the combustion chamber because the intake valve is opened and closed without substantial change in the valve open timing of the intake valve even if there is a change in the maximum lift amount so that the valve overlapping duration hardly changes.

The present invention has been made in view of the above described situation, and the main object of the invention is to provide a valve operating device capable of increasing the negative valve overlapping duration when the maximum lift amounts of the intake valve and the exhaust valve are small. The present invention further contemplates making compact a characteristic adjustment mechanism for adjusting each of the operating characteristics of the intake valve and the exhaust valve, and also further simplifying the structure thereof and causing a decompression operation by the characteristic adjustment mechanisms.

DISCLOSURE OF THE INVENTION

To attain the above objects, the invention provides a valve operating device for an internal combustion engine, including an intake-side cam follower for contacting an intake valve to open and close the intake valve, an exhaust-side cam follower for contacting an exhaust valve to open and close the exhaust valve, and an intake-side characteristic adjustment mechanism and an exhaust-side characteristic adjustment mechanism for respectively adjusting characteristics of the intake valve and the exhaust valve, wherein each of the characteristic adjustment mechanisms comprises: a cam shaft that rotates together with rotation of a crankshaft of the internal combustion engine; a control cam that rotates together with the camshaft; a holder rotatably supported on the cam shaft; a driving device that causes the holder to oscillate around the cam shaft; a rocker lever rotatably supported on the holder to be caused to oscillate by the control cam; and a drive cam that is caused to rotate around the cam shaft by oscillation of the holder transmitted via the rocker lever and by oscillation of the rocker lever, to drive the intake-side cam follower or the exhaust-side cam follower; wherein the driving device of each of the intake-side characteristic adjustment mechanism and the exhaust-side characteristic adjustment mechanism is configured to cause the associated holder to oscillate in such a manner that a valve open timing of the intake valve is retarded as a maximum lift amount of the intake valve becomes smaller and the valve close timing of the exhaust valve is advanced as a maximum lift amount of the exhaust valve becomes smaller.

In this way, in both the characteristic adjustment mechanisms, rotational angle of the rocker lever around the cam shaft, which determines the advance amount of the intake valve open timing and the retardation amount of the exhaust valve close timing, is made to coincide with the rotational angle of the holder which is rotatably supported on the cam shaft on which the valve cam is supported and is oscillated by the driving device. For this reason, it is possible to set an amount of variation of the rotational angle of the rocker lever around the cam shaft to a large value. Accordingly, it is possible to make the negative valve overlapping duration large and to significantly increase the amount of combustion gas retained in the combustion chamber, namely, the internal EGR amount.

As a result, according to the invention, the following effects are achieved. Specifically, the intake-side characteristic adjustment mechanism and the exhaust-side characteristic adjustment mechanism, are provided with the control cam rotating with the cam shaft, the holder rotatably supported on the cam shaft, the driving device for causing the holder to oscillate around the axis of the cam shaft, the rocker lever pivoted on the holder and caused to oscillate by the control cam, and the valve cam that is caused to oscillate by oscillation of the holder and oscillation of the rocker lever to cause oscillation of the intake-side cam follower or the exhaust-side cam follower. With these intake-side characteristic adjustment mechanism and the exhaust-side characteristic adjustment mechanism, it is possible to set an adjustment amount of the rotational angle of the rocker lever around the cam shaft to a large value by causing oscillation of the respective holders around the cam shaft in such a manner that the valve open timing is retarded as the maximum lift amount of the intake valve becomes smaller and the valve close timing is advanced as the maximum lift amount of the exhaust valve becomes smaller. Consequently, it is possible to make the negative valve overlapping duration large by increasing the amount of advancement of the exhaust valve close timing and the amount of retardation of the intake valve open timing. In this way, it is possible to significantly increase the amount of combustion gas retained in the combustion chamber, so that generation of nitroxides is suppressed by the combustion gas retained in the combustion chamber. Further, vaporization of the fuel is promoted by heat of the combustion gas in the combustion chamber, so that hydrocarbon (HC) emission is suppressed with resultant improvement in combustibility, which improves exhaust emissions and reduces pumping loss to improve fuel consumption rate.

In the valve operating device of the present invention, the cam shaft may be a single common cam shaft and the driving device may be a single common driving device shared by both the intake-side characteristic adjustment mechanism and the exhaust-side characteristic adjustment mechanism.

In this way, the cam shafts and driving device are used in common by the intake-side and exhaust-side characteristic adjustment mechanisms.

As a result, the following effect is obtained. That is, it is possible to make the intake-side and exhaust-side characteristic adjustment mechanisms compact, and it is also possible to simplify the structure of the valve operating device with resultant reduction in the costs.

Preferably, the driving device is configured to cause the holder of each of the intake-side characteristic adjustment mechanism and the exhaust-side characteristic adjustment mechanism to swing to a decompression position to open each of the intake valve and the exhaust valve by means of the associated drive cam.

In this way, the holder causes oscillation of the valve cam via the rocker lever, and the valve cam causes the intake valve and exhaust valve to open for decompression operation. As a result, the following effect is obtained. Since the driving device causes the holders of the intake-side and exhaust-side characteristic adjustment mechanisms to oscillate to decompression open positions to open the intake valve and the exhaust valve by the respective drive cams during the compression stroke of the internal combustion engine, in order for the valve cams oscillated by the holders to cause the intake valve and the exhaust valve to open to decompression positions, it is possible to carry out a decompression operation without separately providing a mechanism for carrying out the decompression operation.

Preferably, the driving device comprises a reversible motor, a driving member driven linearly by the motor, and a link connecting the driving member and the holder to each other.

The holder may comprise a pair of plate members supported by the cam shaft for oscillation around the cam shaft and disposed in a spaced disposition with respect to the axial direction of the cam shaft, and a support shaft connecting the plate members in the axial direction of the cam shaft and forming a pivot shaft for pivotal support of the rocker lever on the holder.

Further, the control cam and the drive cam are preferably supported on the cam shaft between the plate members.

The rocker lever is preferably pivoted at one end thereof to the holder and at the other end thereof to the drive cam via a link, and the rocker lever may have at an intermediate part thereof a portion to be acted upon by the control cam.

BEST MODES FOR CARRYING OUT THE INVENTION

Embodiments of the present invention will be described hereafter with reference to FIG. 1 to FIG. 8.

Figure 1:
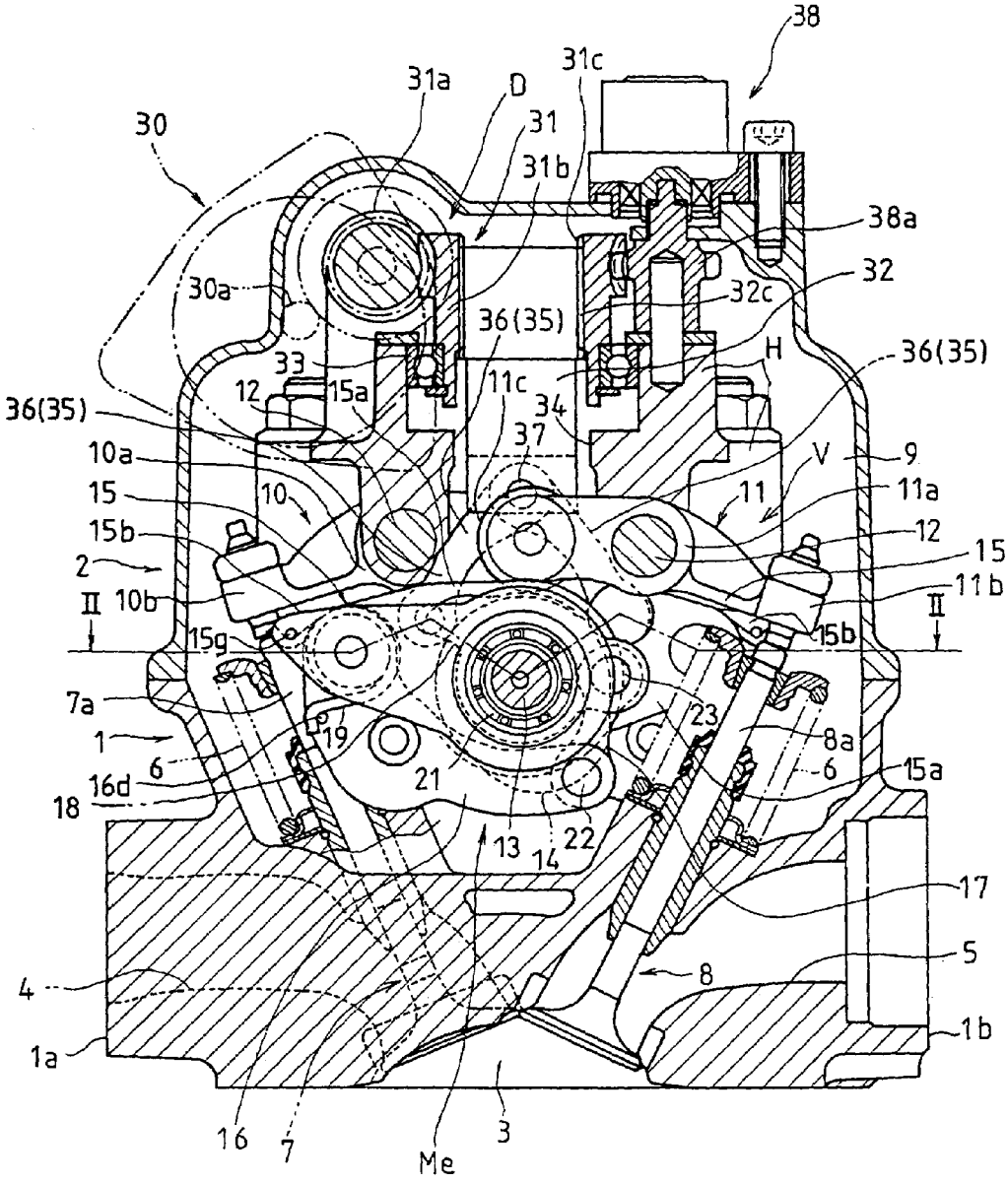
FIG. 1 shows a valve operating device of the embodiment of the present invention and is a cross sectional view of a cylinder head taken along Ia—Ia line in FIG. 2, partly showing a cross section taken along Ib—Ib line, of the cam shaft holder for an internal combustion engine provided with the valve operating device.
Figure 2:
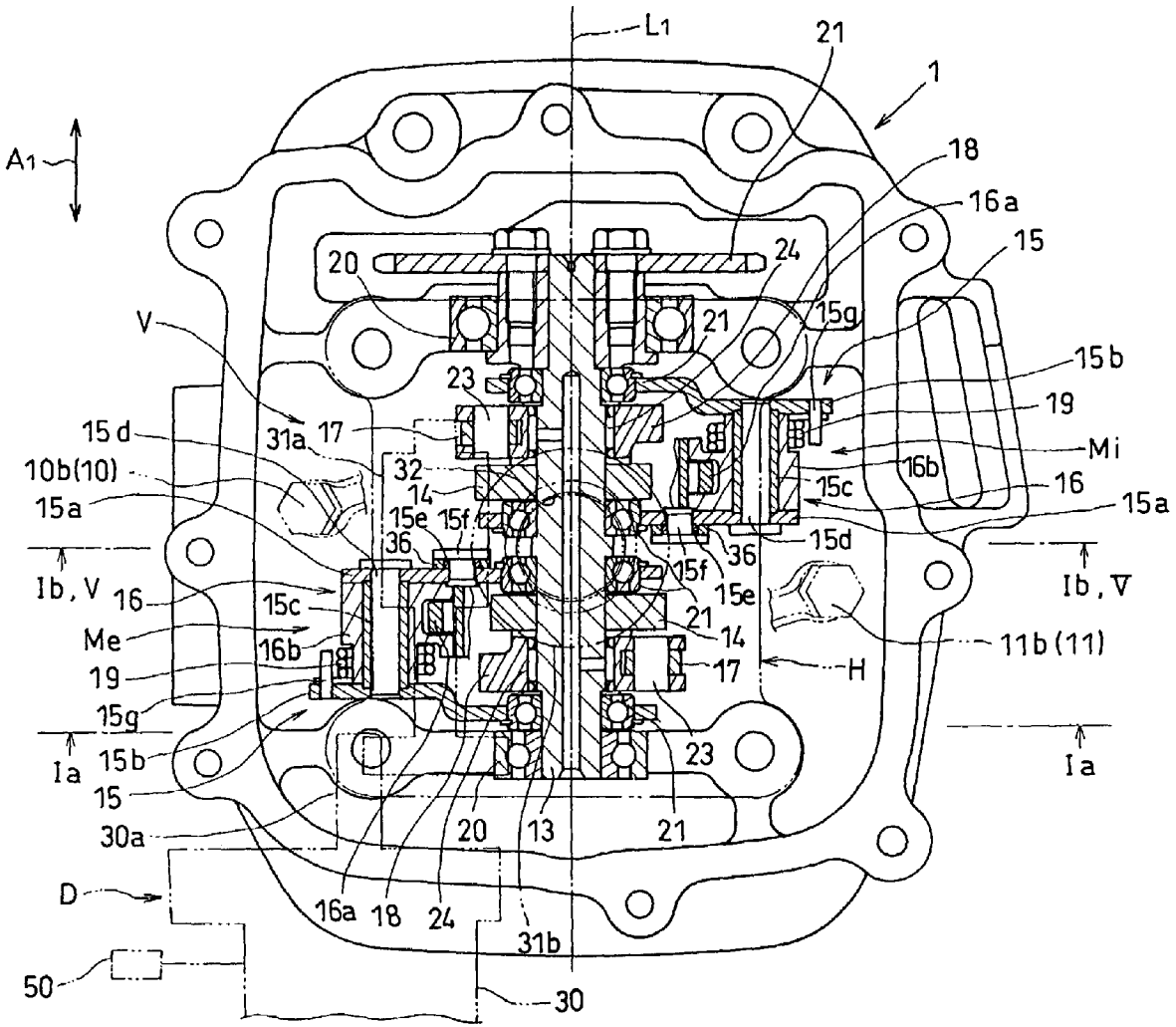
FIG. 2 is a cross sectional view taken along II—II line on FIG. 1.

Referring to FIGS. 1 and 2, an internal combustion engine to which a valve operating device V of the present invention is applied is a SOHC single cylinder 4-cycle engine mounted on a small vehicle or a motorcycle. As shown in FIG. 1, the internal combustion engine comprises a cylinder head 1 coupled to an upper end of a cylinder (not shown in the figure) having a cylinder bore in which a piston (not shown in the figure) is fitted for reciprocation therein, and a head cover 2 coupled to an upper end of the cylinder head 1. A combustion chamber 3 is formed in the cylinder head 1 adjacent to the lower surface thereof, and an intake port 4 and an exhaust port 5 are formed to open in the combustion chamber 3.

An intake opening of the intake port 4 and an exhaust opening of the exhaust port 5 are respectively opened and closed by an intake valve 7 and an exhaust valve 8, respectively, that are reciprocally supported in the cylinder head 1 and urged in normally closed positions by respective valve springs 6. The intake valve 7 and the exhaust valve 8 are opened and closed by the valve operating device V. This valve operating device V, except for an electric motor 30, is arranged inside a valve chamber 9 formed by the cylinder head 1 and the head cover 2.

A fuel supply system for supplying liquid fuel into sucked air, and an intake unit provided with an intake tube for leading a thus formed mixture of fuel and air to the intake port 4, are attached to one side surface 1*a* of the cylinder head 1 where an inlet of the intake port 4 opens out. Also, an exhaust unit provided with an exhaust pipe for leading combustion gas flowing from the combustion chamber through the exhaust port 5 to the outside of the internal combustion engine is attached to the other side surface 1*b* of the cylinder head 1 where an outlet of the exhaust port 5 opens out.

A mixture sucked into the combustion chamber 3 from the intake port 4 in the intake stroke in which the intake valve 7 is opened and the piston is lowered, is compressed by the piston rising in the compression stroke. The mixture is thereafter ignited by a spark plug (not shown) to achieve combustion. The piston that is lowered by the pressure of the combusted gas in the expansion stroke then drives the crankshaft in rotatation via a connecting rod. The combustion gas is discharged to the exhaust port 5 from the combustion chamber 3 as exhaust gas in the exhaust stroke.

The valve operating device V comprises an intake-side main rocker lever 10 as an intake side cam follower for abutting contact with a tip end of a valve stem 7*a* of the intake valve 7 that opens and closes the intake valve 7, and an exhaust-side main rocker lever 11 as an exhaust side cam follower for abutting contact with a tip end of a valve stem 8*a* of the exhaust valve 8 that opens and closes the exhaust valve 8. As shown in FIG. 2, the valve operating device V further comprises an intake-side characteristic adjustment mechanism Mi and an exhaust-side characteristic adjustment mechanism Me for adjusting operational characteristics of the intake valve 7 and the exhaust valve 8, these characteristics here being lift amount and valve opening and closing timings.

The intake-side main rocker lever 10 is supported at a central support section 10*a* thereof for oscillation on a rocker shaft 12 fixed to a stationary cam shaft holder H. The intake-side main rocker lever 10 has at one end thereof an operating section 10*b* for abutting contact with the valve stem 7*a* and at the other end therof a roller 10*c* (FIG. 5) that is in rolling contact with a valve operating cam 18. The roller 10*c* acts as a contact part with the valve operating cam 18 which will be described later. The exhaust-side main rocker lever 11 is supported at a central support section 11*a* thereof for oscillation on another rocker shaft 12 fixed to the stationary cam shaft holder H. The exhaust-side main rocker lever 11 has at one end thereof an operating section 11*b* for abutting contact with the valve stem 8*a* and at the other end therof a roller 11*c* that is in rolling contact with a valve operating cam 18. The roller 11*c* acts as a contact part with the valve operating cam 18.

The intake-side characteristic adjustment mechanism Mi and the exhaust-side characteristic adjustment mechanism Me have basically the same construction. Therefore, description will be made mainly of the intake-side characteristic adjustment mechanism Mi, and, when required, members relating to the exhaust-side characteristic adjustment mechanism Me will be mentioned in brackets.

Figure 5:
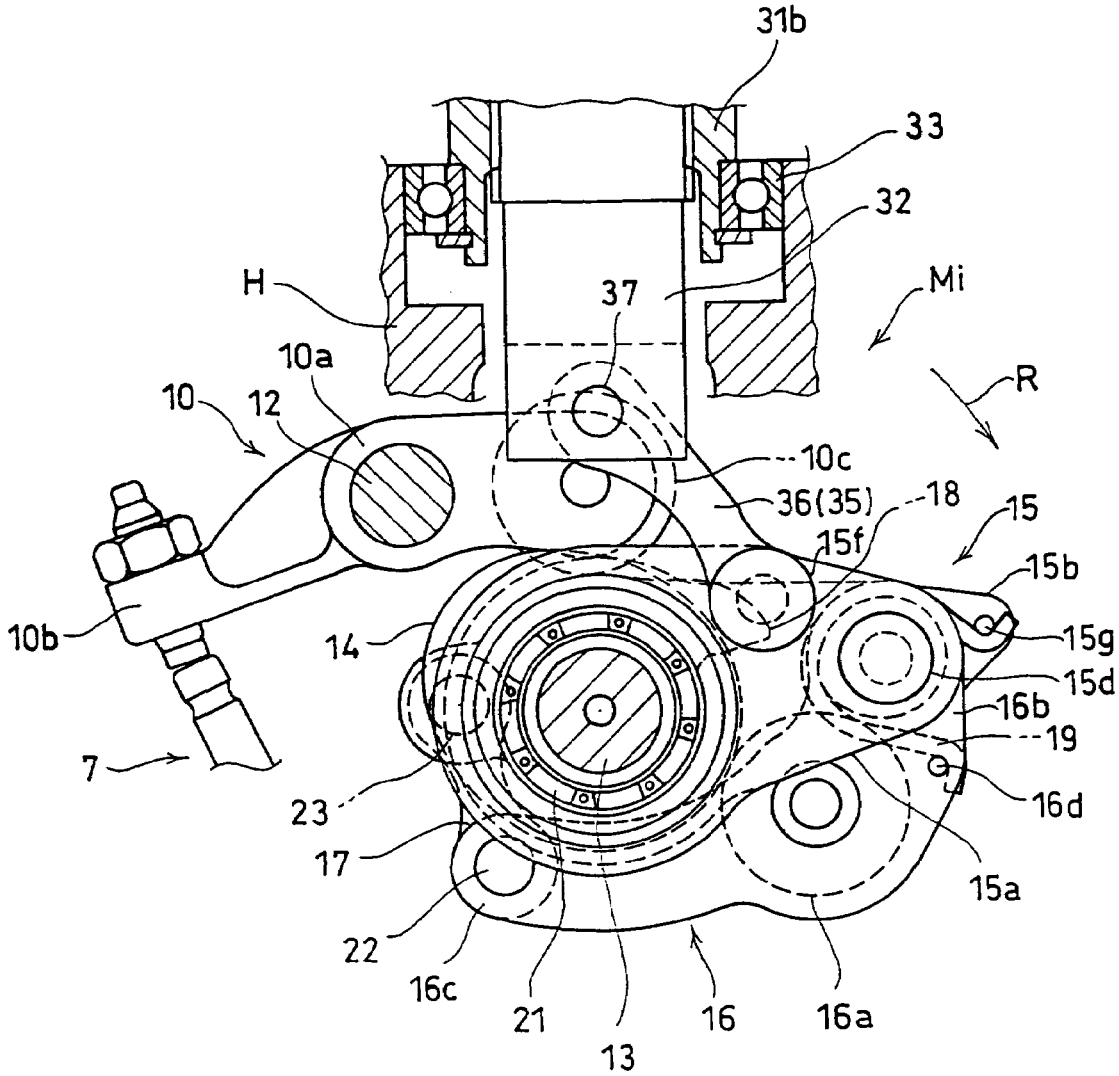
FIG. 5 is a section taken along V—V line in FIG. 2, of part of an intake-side characteristic adjustment mechanism of the valve operating device of FIG. 1, and shows a state in which the intake valve is opened with a high lift amount.

Referring to FIG. 5 as well, the intake-side characteristic adjustment mechanism Mi comprises a single cam shaft 13 shared by the exhaust-side characteristic adjustment mechanism Me, a control cam 14 rotating together with the cam shaft 13, a holder 15 rotatably supported on the cam shaft 13, a driving device D (FIGS. 1 and 2) fixed to the head cover 2 for causing oscillation of the holder 15 about the cam shaft 13, a sub-rocker lever 16 pivoted to the holder 15 and caused to oscillate by the control cam 14, a link 17 connected at one end thereof to the sub-rocker lever 16 so as to be able to swing, the afore-mentioned valve cam 18 rotatably supported on the cam shaft 13 and connected to the other end of the link 17 so as to be able to swing, and a spring 19 constituted by a torsion coil spring as an urging member for urging the sub-rocker lever 16 so as to contact the control cam 14.

When the holder 15 is not oscillated with respect to the cam shaft 13, the valve cam 18 is caused to oscillate around the cam shaft 13 by oscillation of the sub-rocker lever 16 transmitted via the link 17, to cause oscillation of the intake-side main rocker lever 10 (exhaust-side main rocker lever 11) thus causing opening and closing operation of the intake valve 7 (exhaust valve 8). When the holder 15 is caused to oscillate by the driving device D, the valve cam 18 is caused to oscillate around the camshaft 13 by oscillation of the holder 15 transmitted via the sub-rocker lever 16 and the link 17.

As shown in FIG. 2, the cam shaft 13 is rotatably supported in the cylinder head 1 by being held in the cylinder head 1 and the cam shaft holder H connected to the cylinder head 1 by means of a bearing 20 constituted by ball bearings arranged on both ends of the cam shaft 13, and the cam shaft 13 is driven to rotate by rotation of the crankshaft transmitted via a transmission mechanism, in synchronism with half the rotational speed of the crankshaft. A cam sprocket 25 integrally connected to one end of the cam shaft 13 constitutes the transmission mechanism together with a drive sprocket provided on the crankshaft and a timing chain wound around these two sprockets.

Figure 3:
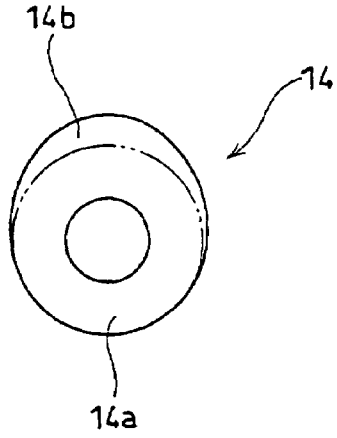
FIG. 3 is a front elevational view of a control cam of the valve operating device of FIG. 1.

Referring to FIG. 3, the control cam 14 is fixed to the cam shaft 13 by press fitting and has a base circular section 14*a* defining the cam surface, and a cam lobe section 14*b* protruding in a radial direction from the base section 14*a*. The control cam 14 has an operating angle range set relative to the crank angle such that the intake valve 7 is caused to open at least in the intake stroke, the sub-rocker lever 16 normally pressed against the cam surface is caused to oscillate, and the oscillated sub-rocker lever 16 causes the valve cam 18 to oscillate via the link 17.

Referring to FIG. 2, the holder 15 is made up of a pair of first and second plates 15*a* and 15*b* as a pair of support sections separated in the direction A1 of the rotational axis L1 of the cam shaft 13 (referred to hereinafter as rotational axis direction A1), a bearing 21 constituted by ball bearings for supporting the plates 15*a*, 15*b* so as to oscillate with respect to the cam shaft 13, a cylindrical collar 15*c* as a support shaft pivoting the sub-rocker lever 16 as well as defining an interval between the first and second plates 15*a* and 15*b* in the rotational axis direction A1, and a rivet 15*d* inserted into the collar 15 to rigidly couple the two plates 15*a*, 15*b*.

A collar 15*e* as a support shaft for pivoting a swingable link 36 described later is fixed to the first plate 15*a*, using a rivet 15*f* that is inserted into the collar 15*e*. A pin 15*g* for abutting one end of the spring 19 is provided on the second plate 15*b*.

Figure 4A:
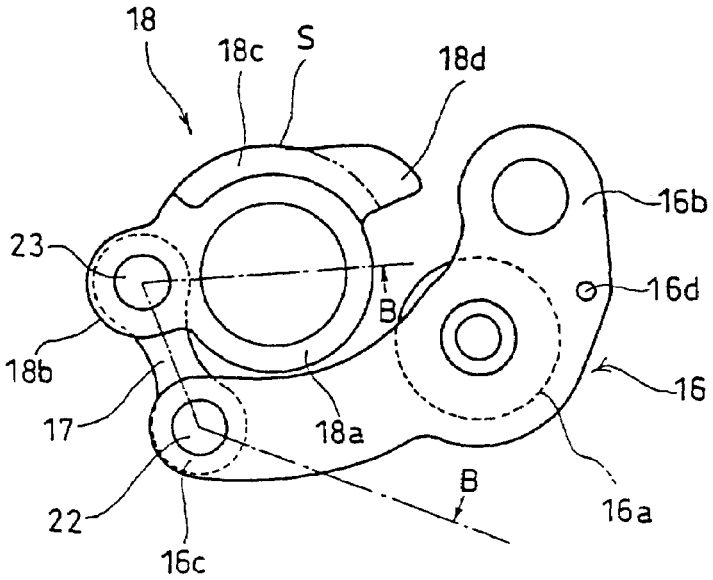
FIG. 4A is a front elevational view of a sub-rocker lever, link and valve cam in a mutually linked state, in an exhaust-side characteristic adjustment mechanism of the valve operating device of FIG. 1.
Figure 4B:
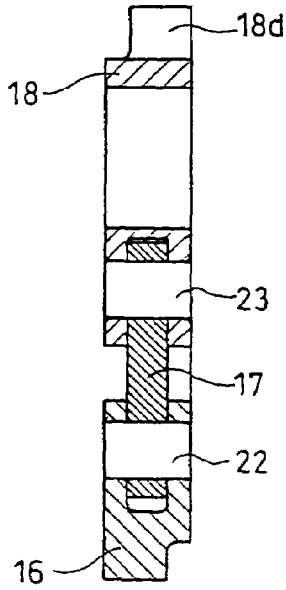
FIG. 4B is a cross section along B—B line in FIG. 4A.

Referring to FIGS. 4A and 4B, the sub-rocker lever 16 has a roller 16*a* provided at a middle part thereof as a contact section for contacting the control cam 14, i.e., it comes into rolling contact with the control cam 14. The sub-rocker lever 16 also has a supported section 16*b* at one end that is supported on the collar 15*c* for oscillation, and a connecting section 16*c* at the other end pivoted on a link pin 22 fixed to one end of the link 17. Therefore, the sub-rocker lever 16 is oscillated with the collar 15*c* as an oscillation center by rotation of the control cam 14.

A pin 16*d* is provided on the sub-rocker lever 16 for abutting with the other end of the spring 19 that is arranged around the outer periphery of the collar 15*c*. The roller 16*a* of the sub-rocker lever 16 is then normally pressed against the control cam 14 by the spring 19, and vibration of the sub-rocker lever 16 due to inertial forces acting on the sub-rocker lever 16, link 17 and valve cam 18 is prevented.

As shown in FIG. 2, the link 17 is disposed adjacent to the control cam 14 with respect to the rotational axis direction A1 and a link pin 23 (FIGS. 4A and 4B) is fixed to the other end of the link 17, and the valve cam 18 is pivoted swingably on the link pin 23 through a bearing 24 in the form of a needle bearing. As shown in FIG. 4A, the valve cam 18 has an annular holding section 18*a* for holding the bearing 24 and a link connecting section 18*b* for pivotal connection to the link 17 through a pin 23.

A cam surface S is formed on a part of the outer peripheral surface of the annular holding section 18*a*. This cam surface S is defined by a base section 18*c* for keeping the intake valve 7 (exhaust valve 8) in a closed state, and a cam land section 18*d* continuing from the base section 18*c* and projecting outwards in a radial direction. The cam land section 18*d* is for causing the intake valve 7 (exhaust valve 8) to open via the intake-side main rocker lever 10 (exhaust-side main rocker lever 11) and has such a shape that the lift amount of the intake valve 7 (exhaust valve 8) becomes gradually larger in the rotational direction R of the cam shaft 13.

Therefore, when the rotational positions of the holder 15 around the cam shaft 13 or the control cam 14 and of the sub-rocker lever 16 are not changed in the rotational direction R of the cam shaft 13 (refer to FIG. 5), the valve open duration of the intake valve 7 (exhaust valve 8) is shortened and the maximum lift amount is reduced, as the valve cam 18 rotates in the rotational direction R of the cam shaft 13.

Then, as shown in FIG. 2, with the holder 15, control cam 14, sub-rocker lever 16, link 17 and valve cam 18 attached to the cam shaft 13, the control cam 14, sub-rocker lever 16, link 17, spring 19 and valve cam 18 are arranged between the first and second plates 15*a* and 15*b* in the rotational axis direction A1.

Referring to FIG. 1 and FIG. 2, the single driving device D shared by the intake-side characteristic adjustment mechanism Mi and the exhaust-side characteristic adjustment mechanism Me includes an electric motor 30 as an actuator, capable of rotation in the reverse direction, fixed to the outer surface of the head cover 2, a drive rod 32 as a drive member driven by the electric motor 30, and a transmission mechanism 31 for transmitting rotation of the electric motor 30 to the drive rod 32. The transmission mechanism 31 is arranged inside the valve chamber 9 and is made up of a worm 31*a* rotationally driven by a rotating shaft 30*a* of the electric motor 30 extending inside the valve chamber 9 through the head cover 2, and a worm wheel 31*b* meshing with the worm 31*a*.

A feed screw mechanism is provide between the worm wheel 31*b* and the drive rod 32, as a motion translator for translating rotational movement of the worm wheel 31*b* to linear reciprocal motion of the drive rod 32. In order to configure this feed screw mechanism, a female screw section 31*c* is formed in the inner surface of the worm wheel 31*b*, and a male screw section 32*c* for screw engagement with the female screw section 31*c* is formed on the outer surface of the drive rod 32. The worm wheel 31*b* is rotatably supported on the cam shaft holder H by way of a bearing 33, being a ball bearing, and the drive rod 32 passes through a through hole 34 formed in the cam shaft holder H and is capable of advancing and retreating motion inside the valve chamber 9.

As shown in FIG. 5, a link 36 constituting a transmission mechanism 35 for transmitting motion of the drive rod 32 to the holder 15 to cause oscillation of the holder 15 about the cam shaft 13 is provided between the drive rod 32 and the holder 15. The link 36, as described previously, is mounted on the first plate 15*a* at one end for oscillating motion, and mounted on the drive rod 32 at the other end so as to be capable of swinging by pivoting on the link pin 37 fixed to the drive rod 32.

The electric motor 30 is controlled by a controller 50 (FIG. 2) that receives input of detection signals from various sensors for detecting engine operating conditions, such as load on the engine, rotational speed, crank angle, being the rotational position of the crank shaft, and cam angle, being the rotational position of the cam shaft 13 at start of the engine, as well as input from a potentiometer 38 (FIG. 1) as a sensor for detecting the operating condition of the electric motor 30.

Operating conditions such as the amount of rotation of the electric motor 30, direction of rotation, rotation timing and stop timing, etc., are controlled according to engine operating conditions, based on a control map in which relationships between engine operating conditions and operating conditions of the electric motor 30 are set in advance. When the position of the drive rod 32 changes, respective positions of the holder 15, the collar 15*c* as the swing center of the sub-rocker lever 16, and the valve cam 18 about the cam shaft 13, namely the oscillation positions of the above elements, are changed according to the engine operating conditions. Actual operating conditions of the electric motor 30 are detected by means of detection of the amount of rotation and the direction of rotation of the worm wheel 31*b* using a potentiometer 38 having a detection rod 38*a* that is driven to rotate by meshing with the worm wheel 31*b*, and a detection signal from the potentiometer 38 is fed back to the controller 50.

Figure 7:
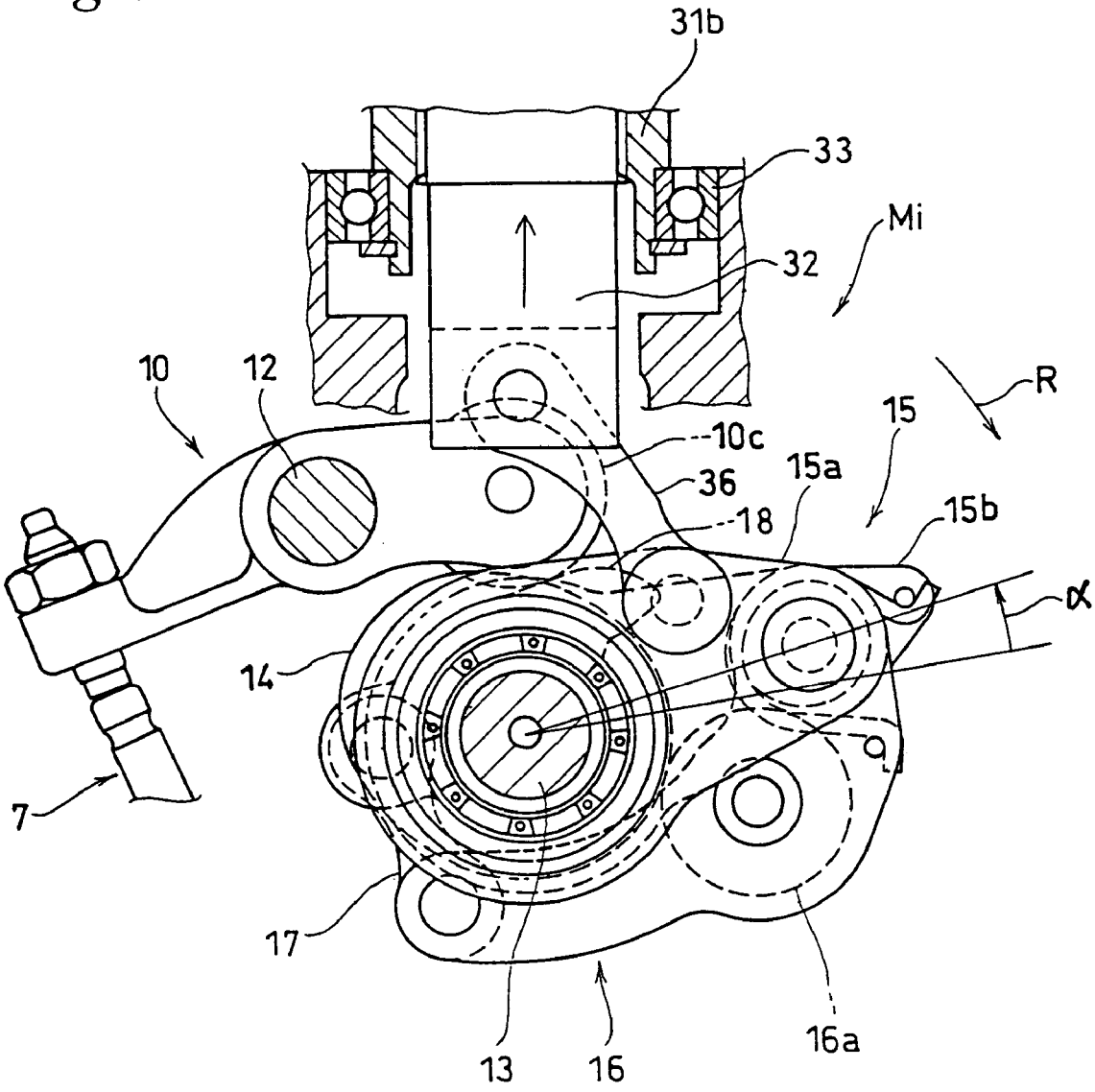
FIG. 7 is a view similar to FIG. 5, but showing a state where the intake valve is opened to a decompression opening amount.
Figure 8:
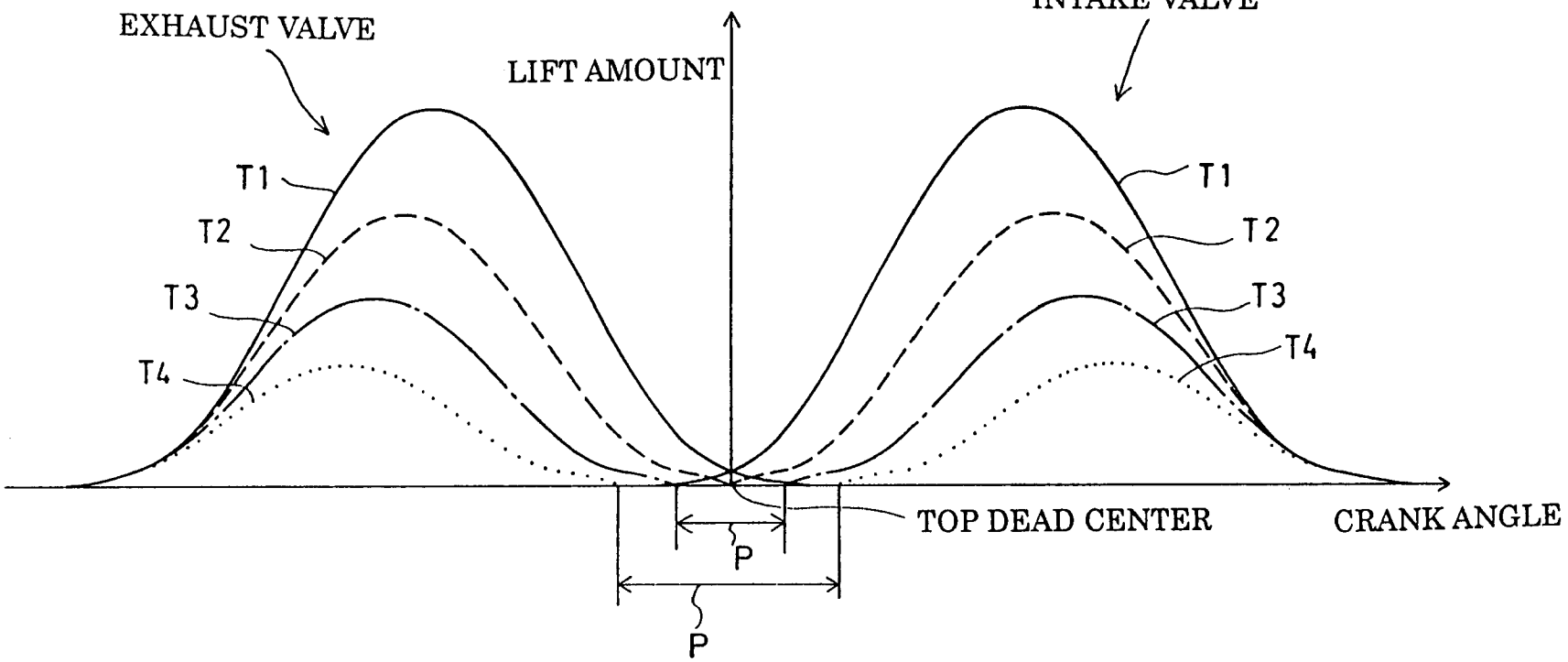
FIG. 8 is a graph showing operating characteristics of an intake valve and an exhaust valve operated by the valve operating device of FIG. 1.

In the control map, the amount of movement of the drive rod 32 that is also the amount of drive (amount of rotation) of the electric motor 30, and hence the rotational angle α (Refer to FIG. 6 and FIG. 7) is set as indicated in FIG. 8. The rotational angle α is equal to the angle of rotation of the sub-rocker lever 16 about the oscillation center thereof and to the angle of rotation of the valve cam 18 about the cam shaft 13. This angle of rotation will hereinafter be referred to as "phase control angle". As will be seen from FIG. 8, the rotational angle α is set to such a value that the intake valve 7, of which a maximum lift amount and the open and close timings are varied by the intake-side characteristic adjustment mechanism Mi, has its valve open timing continuously retarded while the valve close timing is kept constant or almost constant as the maximum lift amount of the intake valve 7 becomes continuously smaller, and that the exhaust valve 8, of which a maximum lift amount and the open and close timings are varied by the exhaust-side characteristic adjustment mechanism Me, has its valve close timing continuously advanced while the valve open timing is kept constant or almost constant as the maximum lift amount of the exhaust valve 8 becomes continuously smaller.

In this control map, the amount of movement of the drive rod 32 is so set that at the time of the compression stroke when starting the internal combustion engine, the holders 15 of the intake-side and exhaust-side characteristic adjustment mechanisms Mi and Me, and the valve cam 18, are caused to rotate by the drive rod 32 in the opposite direction to the rotational direction R (refer to FIG. 5), the cam land section 18*d* of the valve cam 18 is brought into contact with the rollers 10*c* and 11*c* of the intake-side and exhaust-side main rocker levers 10, 11, and the intake valve 7 and the exhaust valve 8 are opened with a small amount of decompression opening.

Next, the operation of the embodiment configured as described above will be described.

For example, in an operating region of the internal combustion engine such as a high load operating region where intake amount is large, the intake valve 7 and the exhaust valve 8 are opened with a large maximum lift amount and a long valve open duration, as indicated, for example by the solid line T1 in FIG. 8, and the valve overlapping duration is also made large to enable high output operation.

In an operating region where intake amount is small, such as a low load operating region or low speed operating region, as indicated, for example, by the single dot dashed line T3 and the dotted line T4, the maximum lift amount and the valve open duration for the intake valve 7 are reduced, and in order to cause a large amount of combustion gas to be retained in the combustion chamber 3, the intake-side and exhaust-side characteristic adjustment mechanism Mi and Me operate so as to advance the valve close timing of the exhaust valve 8 and the retard the valve open timing of the intake valve 7.

A specific example will be given below. Because the intake-side characteristic adjustment mechanism Mi operates at the same time with and in the same way as the exhaust-side characteristic adjustment mechanism Me, description in the following will be made mainly on the intake-side characteristic adjustment mechanism Mi with reference to FIG. 1, and FIGS. 5–8, and corresponding elements of the exhaust-side characteristic adjustment mechanism Me will be mentioned in brackets with description of these elements being dispensed with.

Figure 6:
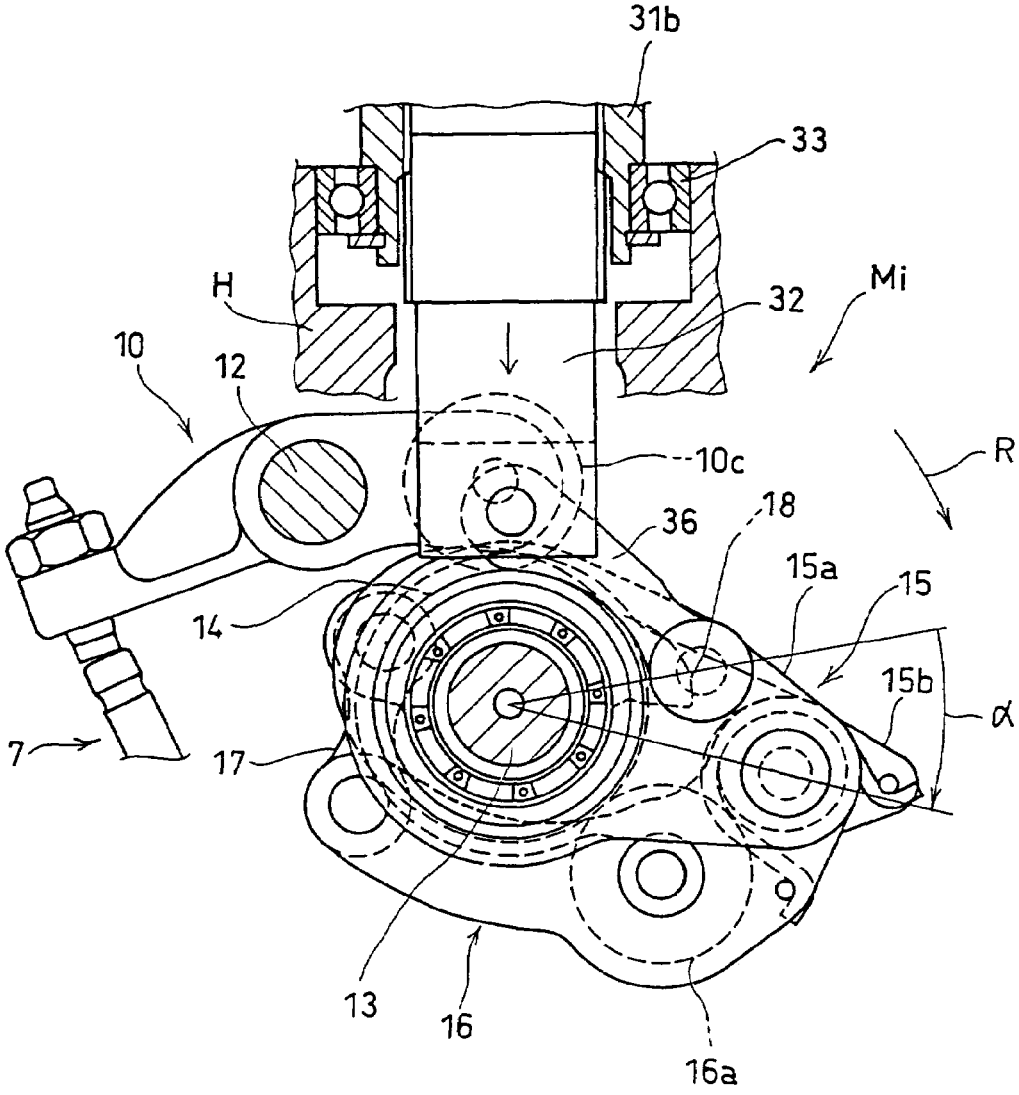
FIG. 6 is a view similar to FIG. 5, but showing a state where the intake valve is opened with a low lift amount.

Transition is carried out as stated below from a state of the intake-side characteristic adjustment mechanism Mi (exhaust-side characteristic adjustment mechanism Me) in which the intake valve 7 (exhaust valve 8) is open with a high lift amount, which is an operating region where the intake amount is large as shown in FIG. 5, to a state in which the intake valve 7 (exhaust valve 8) is open with a low lift amount, which is an operating region where the intake amount is small as shown in FIG. 6.

The worm 31*a* and worm wheel 31*b* are driven to rotate by the electric motor 30 that is controlled by the controller 50, and the drive rod 32 is advanced in the valve chamber 9 by the feed screw mechanism. At this time, the drive rod 32 rotates the holder 15 about the cam shaft 13 in the rotational direction R via the link 36, by the phase control angle α set by the control map, and at the same time the sub-rocker lever 16, link 17 and valve cam 18 rotate about the cam shaft 13 in the rotational direction R by the same phase control angle α. In this way, corresponding to the range of oscillation of the sub-rocker lever 16 caused by the control cam 14 rotating together with the cam shaft 13, an increased proportion of the cam surface S (refer to FIG. 4A) of the valve cam 18, within the range in which contact is made with the roller 10*c* (roller 11*c*), is caused to contact the roller 10*c* (roller 11*c*) at the base section 18*c* thereof, and a reduced proportion of the cam surfaces is caused to contact the roller 10*c* (roller 11*c*) at the cam land section 18*d*, as compared with an operating region where the intake amount is large, with the result that the maximum lift amount of the intake valve 7 (exhaust valve 8) is reduced and the valve open duration is shortened.

At this time, since the sub-rocker lever 16 occupies a position where it has rotated around the control cam 14 in the rotational direction R by the phase control angle α, the valve open timing (valve close timing) of the intake valve 7 (exhaust valve 8) is correspondingly retarded (advanced), while keeping the valve close timing (valve open timing) the same or almost the same, as compared with an operating region where the intake amount is large.

For this reason, as will be noted from the curves T2, T3 and T4 in FIG. 8 in the case where the phase control angle α of the holder 15 in the rotational direction R is larger, as the phase control angle α of the holder 15 in the rotational direction R becomes larger, the maximum lift amount of the intake valve 7 and the exhaust valve 8 becomes smaller, the valve open duration is shortened, the valve close timing of the exhaust valve 8 is advanced significantly, and the valve open timing of the intake valve 7 is retarded significantly, so that the valve overlapping duration is shortened, a negative valve overlapping duration P is increased, and a large amount of combustion gas is retained in the combustion chamber 3.

At the time of the compression stroke at starting of the engine, as shown in FIG. 7, the holder 15 is rotated in the opposite direction to the rotational direction R, as a result of the electric motor 30 causing the drive rod 32 to move backwards. Then, the valve cam 18 is rotated in the opposite direction to the rotational direction R via the sub-rocker lever 16 and the link 17 by the rotating holder 15, the rollers 10*c* and 11*c* of the intake-side and exhaust-side main rocker levers 10 and 11 come into contact with the cam land section 18*b*, and the intake valve 7 and the exhaust valve 8 are opened with a decompression opening. In this way, compression pressure is lowered and engine starting is made easy.

Effects of the above-described embodiment will now be described.

As stated above, each of the intake-side characteristic adjustment mechanism Mi and the exhaust-side characteristic adjustment mechanism Me is provided with the control cam 14 rotating integrally with the cam shaft 13, the driving device D for causing the holder 15 pivoted on the cam shaft 13 to oscillate around cam shaft 13, the sub-rocker lever 16 pivoted on the holder 15 and caused to oscillate by the control cam 14, and the valve cam 18 caused to oscillate by oscillation of the holder 15 and oscillation of the sub-rocker lever 16 for operating the intake-side main rocker lever 10 or the exhaust-side main rocker lever 11. Further, the intake-side characteristic adjustment mechanism Mi and the exhaust-side characteristic adjustment mechanism Me are configured such that the phase control angle $\alpha$ of the sub-rocker lever 16 around the cam shaft 13, for determining the amount of retardation of the valve open timing of the intake valve 7 and the amount of advancement of the valve close timing of the exhaust valve 8, is made to coincide with the phase control angle $\alpha$ of the holder 15 that is pivoted on the cam shaft 13 supporting the valve cam 18 and caused to oscillate by the driving device D. As a result, the phase control angle $\alpha$ can be set to have a large variable amount. Therefore, by increasing the amount of advancement of the valve close timing of the exhaust valve 8 and the amount of advancement of the valve open timing of the intake valve 7, the negative valve overlapping duration can be made longer. As a result, it is possible to make the amount of combustion gas retained in the combustion chamber 3, i.e., the internal EGR amount, significantly large. Consequently, the combustion temperature is lowered by the combustion gas retained in the combustion chamber 3 so as to suppress the generation of nitroxides. Further, vaporization of the fuel is promoted using heat of the retained combustion gas, combustibility is improved together with suppression of hydrocarbon (HC) discharge, exhaust emissions are improved, and pumping loss is reduced to improve fuel consumption rate.

In the intake-side characteristic adjustment mechanism Mi and the exhaust-side characteristic adjustment mechanism Me, the cam shaft 13 is a single common cam shaft, and the driving device D is a single common driving device, which means that the cam shaft 13 and the driving device D are shared by both the intake-side and exhaust-side characteristic adjustment mechanisms Mi and Me, so that it is possible to make compact the intake-side and exhaust-side characteristic adjustment mechanisms Mi and Me, and to make the entire structure simple with reduction of the costs.

At the compression stroke of the internal combustion engine, the drive rod 32 driven and moved by the electric motor 30 causes the holders 15 of the intake-side and exhaust-side characteristic adjustment mechanisms Mi and Me to oscillate to decompression positions in which the intake valve 7 and the exhaust valve 8 are opened by the respective valve cams 18, and in this way the valve cams 18 that are caused to operate by the holders 15 open the intake valve 7 and the exhaust valve 8 at decompression opening amounts, making it possible to carry out a decompression operation without separately providing a mechanism for carrying out the decompression operation.

In the following, description will be given for modified structures where part of the structure of the above-described embodiment is changed.

In the above described embodiment, the cam follower is a rocker lever, but the cam follower may also be a lifter or a swing arm. Also, the cam shaft can be replaced by a pair of cam shafts, being an intake-side cam shaft and an exhaust-side camshaft, and it is possible for the driving device to be provided for each of the intake-side and exhaust-side characteristic adjustment mechanisms Mi and Me.

The internal combustion engine of the above-described embodiment is of a single cylinder type, but multiple cylinders could also be provided, in which case the intake-side and exhaust-side characteristic adjustment mechanisms Mi and Me sharing a single driving device are provided for each cylinder.

What is claimed is:

1. A valve operating device for an internal combustion engine, including an intake-side cam follower for contacting an intake valve to open and close the intake valve, an exhaust-side cam follower for contacting an exhaust valve to open and close the exhaust valve, and an intake-side characteristic adjustment mechanism and an exhaust-side characteristic adjustment mechanism for respectively adjusting characteristics of the intake valve and the exhaust valve, wherein each of the characteristic adjustment mechanisms comprises:

a cam shaft that rotates together with rotation of a crankshaft of the internal combustion engine;

a control cam that rotates together with the cam shaft;

a holder rotatably supported on the cam shaft;

a driving device that causes the holder to oscillate around the cam shaft;

a rocker lever rotatably supported on the holder to be oscillated by the control cam; and a drive cam that is caused to rotate around the cam shaft by oscillation of the holder transmitted via the rocker lever and by oscillation of the rocker lever, to drive the intake-side cam follower or the exhaust-side cam follower;

wherein the driving device of each of the intake-side characteristic adjustment mechanism and the exhaust-side characteristic adjustment mechanism is configured to cause the associated holder to oscillate in such a manner that a valve open timing of the intake valve is retarded as a maximum lift amount of the intake valve becomes smaller and the valve close timing of the exhaust valve is advanced as a maximum lift amount of the exhaust valve becomes smaller.

2. The valve operating device for an internal combustion engine according to claim 1, wherein the cam shaft is a single common cam shaft and the driving device is a single common driving device shared by both the intake-side characteristic adjustment mechanism and the exhaust-side characteristic adjustment mechanism.

3. The valve operating device for an internal combustion engine according to claim 2, wherein the driving device is configured to cause the holder of each of the intake-side characteristic adjustment mechanism and the exhaust-side characteristic adjustment mechanism to swing to a decompression position to open each of the intake valve and the exhaust valve by means of the associated drive cam.

4. The valve operating device for an internal combustion engine according to claim 1, wherein the driving device comprises a reversible motor, a driving member driven linearly by the motor, and a link connecting the driving member and the holder to each other.

5. The valve operating device for an internal combustion engine according to claim 1, wherein the holder comprises a pair of plate members supported by the cam shaft for oscillation around the cam shaft and disposed in a spaced disposition with respect to the axial direction of the cam shaft, and a support shaft connecting the plate members in the axial direction of the cam shaft and forming a pivot shaft for pivotal support of the rocker lever on the holder.

6. The valve operating device for an internal combustion engine according to claim 5, wherein the control cam and the drive cam are supported on the cam shaft between the plate members.

7. The valve operating device for an internal combustion engine according to claim 1, wherein the rocker lever is pivoted at one end thereof to the holder and at the other end thereof to the drive cam via a link, and the rocker lever has at an intermediate part thereof a portion to be acted upon by the control cam.

8. The valve operating device for an internal combustion engine according to claim 1, wherein the driving device is reversible so as to oscillate the holder in opposite directions, when the holder is oscillated in one direction the valve open timing of the intake valve is retarded as the maximum lift amount of the intake valve becomes smaller and the valve close timing of the exhaust valve is advanced as the maximum lift amount of the exhaust valve becomes smaller, and when the holder is oscillated in the opposite direction the holder of the corresponding intake-side characteristic adjustment mechanism or the exhaust-side characteristic adjustment mechanism swings to a decompression position to open the intake valve or the exhaust valve by means of the associated drive cam.

9. The valve operating device for an internal combustion engine according to claim 1, wherein the driving device is a single common driving device shared by both the intake-side characteristic adjustment mechanism and the exhaust-side characteristic adjustment mechanism.

* * * * *

UNITED STATES PATENT AND TRADEMARK OFFICE

CERTIFICATE OF CORRECTION

PATENT NO. : 6,990,938 B2 
APPLICATION NO. : 10/495195
DATED : January 31, 2006
INVENTOR(S) : Yutaka Inomoto et al.

It is certified that error appears in the above-identified patent and that said Letters Patent is hereby corrected as shown below:

Title Page, Section 54:

Change "VALVE MECHANISM TOR INTERNAL COMBUSTION ENGINE"

To -- VALVE OPERATING MECHANISM FOR INTERNAL COMBUSTION ENGINE--

Section 57:

Replace entire abstract with --A valve Operating device for an internal combustion engine is provided with intake-side and exhaust-side charateristic adjustment mechanisms capable of increasing a negative valve overlapping duration when maximum life amounts of an intake valve and an exhaust valve are small. Each characteristic adjustment mechanism has a control cam, and electric motor that causes a holder pivoted on the cam shaft to rotate about the cam shaft, a sub-rocker lever pivoted on the holder, and a valve cam that is caused to oscillate around the cam shaft by oscillation of main rocker levers. The device is configures is such a manner that the valve open timing of the intake valve is retarded as a maximum lift amount of the intake valve becomes smaller and the valve close timing of the exhaust valve is advanced as a maximum lift amount of the exhaust valve becomes smaller. --

Column 1:

Line 1, change "VALVE MECHANISM FOR INTERNAL COMBUSTION ENGINES"

to -- VALVE OPERATING MECHANISM FOR INTERNAL COMBUSTION ENGINE --.

UNITED STATES PATENT AND TRADEMARK OFFICE

CERTIFICATE OF CORRECTION

PATENT NO. : 6,990,938 B2
APPLICATION NO. : 10/495195
DATED : January 31, 2006
INVENTOR(S) : Yutaka Inomoto et al.

It is certified that error appears in the above-identified patent and that said Letters Patent is hereby corrected as shown below:

Column 10:

Line 36, change "reduced proportion of the cam surfaces is caused to contact." to -- reduced proportion of the cam surface S is caused to contact --.

Signed and Sealed this

Eighth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,990,938 B2
APPLICATION NO. : 10/495195
DATED : January 31, 2006
INVENTOR(S) : Yutaka Inomoto et al.

It is certified that error appears in the above-identified patent and that said Letters Patent is hereby corrected as shown below:

Title Page, Section 54:

Change "VALVE MECHANISM TOR INTERNAL COMBUSTION ENGINE"
To -- VALVE OPERATING MECHANISM FOR INTERNAL COMBUSTION ENGINE--

Section 57:

Replace entire abstract with --A valve Operating device for an internal combustion engine is provided with intake-side and exhaust-side charateristic adjustment mechanisms capable of increasing a negative valve overlapping duration when maximum life amounts of an intake valve and an exhaust valve are small. Each characteristic adjustment mechanism has a control cam, and electric motor that causes a holder pivoted on the cam shaft to rotate about the cam shaft, a sub-rocker lever pivoted on the holder, and a valve cam that is caused to oscillate around the cam shaft by oscillation of main rocker levers. The device is configured in such a manner that the valve open timing of the intake valve is retarded as a maximum lift amount of the intake valve becomes smaller and the valve close timing of the exhaust valve is advanced as a maximum lift amount of the exhaust valve becomes smaller. --

Column 1:

Line 1, change "VALVE MECHANISM FOR INTERNAL COMBUSTION ENGINES"
to -- VALVE OPERATING MECHANISM FOR INTERNAL COMBUSTION ENGINE--.

UNITED STATES PATENT AND TRADEMARK OFFICE

CERTIFICATE OF CORRECTION

PATENT NO. : 6,990,938 B2
APPLICATION NO. : 10/495195
DATED : January 31, 2006
INVENTOR(S) : Yutaka Inomoto et al.

It is certified that error appears in the above-identified patent and that said Letters Patent is hereby corrected as shown below:

Column 10:

Line 36, change "reduced proportion of the cam surfaces is caused to contact." to -- reduced proportion of the cam surface S is caused to contact --.

This certificate supersedes Certificate of Correction issued August 8, 2006.

Signed and Sealed this

Twenty-fourth Day of July, 2007

JON W. DUDAS
*Director of the United States Patent and Trademark Office*

UNITED STATES PATENT AND TRADEMARK OFFICE

CERTIFICATE OF CORRECTION

PATENT NO. : 6,990,938 B2
APPLICATION NO. : 10/495195
DATED : January 31, 2006
INVENTOR(S) : Yutaka Inomoto et al.

It is certified that error appears in the above-identified patent and that said Letters Patent is hereby corrected as shown below:

Title Page, Section 54:

Change "VALVE MECHANISM FOR INTERNAL COMBUSTION ENGINES"
To -- VALVE OPERATING DEVICE FOR INTERNAL COMBUSTION ENGINE--

Section 57:

Replace entire abstract with --A valve Operating device for an internal combustion engine is provided with intake-side and exhaust-side charateristic adjustment mechanisms capable of increasing a negative valve overlapping duration when maximum life amounts of an intake valve and an exhaust valve are small. Each characteristic adjustment mechanism has a control cam, and electric motor that causes a holder pivoted on the cam shaft to rotate about the cam shaft, a sub-rocker lever pivoted on the holder, and a valve cam that is caused to oscillate around the cam shaft by oscillation of main rocker levers. The device is configured in such a manner that the valve open timing of the intake valve is retarded as a maximum lift amount of the intake valve becomes smaller and the valve close timing of the exhaust valve is advanced as a maximum lift amount of the exhaust valve becomes smaller. --

In section (74), *Attorney*, *Agent*, *or Firm*, change "Carrier Blackman &" to --Carrier, Blackman &--.

Column 1:

Line 1, change "VALVE MECHANISM FOR INTERNAL COMBUSTION ENGINES"
to -- VALVE OPERATING DEVICE FOR INTERNAL COMBUSTION ENGINE--.
Line 6, change "relates to valve" to --relates to a valve--.

Column 2:

Line 7, change "intake vales" to --intake valves--.
Line 28, change "exhaust stroke and to" to --exhaust stroke to--.
Line 29, change "overlaping" to --overlapping--.

Column 3:

Line 42, change "With these intake-side" to --With the intake-side--.

UNITED STATES PATENT AND TRADEMARK OFFICE

CERTIFICATE OF CORRECTION

PATENT NO. : 6,990,938 B2
APPLICATION NO. : 10/495195
DATED : January 31, 2006
INVENTOR(S) : Yutaka Inomoto et al.

It is certified that error appears in the above-identified patent and that said Letters Patent is hereby corrected as shown below:

Column 5:
Line 42, change "a thus formed mixture" to --a thus-formed mixture--.
Line 62, change "intake side cam" to --intake-side cam--.
Line 65, change "exhaust side cam" to --exhaust-side cam--.

Column 6:
Line 13, change "other end therof" to --other end thereof--.
Line 22, change "therof a roller" to --thereof a roller--.

Column 8:
Line 31, change "is provide between" to --is provided between--.

Column 9:
Line 66, change "and the retard" to --and to retard--.

Column 10:
Line 36, change "reduced proportion of the cam surfaces is caused to contact." to -- reduced proportion of the cam surface S is caused to contact --.

Column 12:
Line 6, change "above described" to --above-described--.
Line 10, change "exhaust-side camshaft" to --exhaust-side cam shaft--.

This certificate supersedes all previously issued Certificate of Correction.

Signed and Sealed this

Thirtieth Day of October, 2007

JON W. DUDAS
*Director of the United States Patent and Trademark Office*